United States Patent [19]

Blackburn, deceased

[11] 4,317,260

[45] Mar. 2, 1982

[54] METHOD IMPROVEMENT TO INCREASE THE PROPORTION OF USABLE FIBERS IN PROCESSABLE TEXTILE FIBER STOCK

[75] Inventor: Reginald M. Blackburn, deceased, late of Accrington, England, by Althea Blackburn, administratrix

[73] Assignee: Platt Saco Lowell Limited, United Kingdom

[21] Appl. No.: 972,140

[22] Filed: Dec. 21, 1978

[30] Foreign Application Priority Data

Dec. 24, 1977 [GB] United Kingdom ..... 53895/77

[51] Int. Cl.[3] ..... D01G 9/12; D01G 9/16

[52] U.S. Cl. ..... 19/107; 19/204

[58] Field of Search ..... 19/107, 204

[56] References Cited

U.S. PATENT DOCUMENTS 2,810,163 10/1957 Kyame et al. ..... 19/107 X 2,857,627 10/1958 Berberich ..... 19/107

2,959,824 11/1960 Asti et al. ..... 19/107

FOREIGN PATENT DOCUMENTS 2300828 10/1976 France ..... 19/107

*Primary Examiner*—Louis Rimrodt

*Attorney, Agent, or Firm*—Donald H. Feldman

[57] ABSTRACT

In opening and cleaning fibers an improved method to increase the proportion of usable fibers in processable textile fiber stock using a plurality of bale opening machines feeding fiber to a line of fiber cleaning and mixing machines, following which the fibers are fed to a plurality of carding machines. At least some of the machines settings are adjusted to remove a higher level of waste, including trash and good fiber, than would conventionally be acceptable. The waste from the machines is centrally collected and passed to a fiber retriever which removes good fibers to return them into the line of cleaning and mixing machines.

5 Claims, 2 Drawing Figures

METHOD IMPROVEMENT TO INCREASE THE PROPORTION OF USABLE FIBERS IN PROCESSABLE TEXTILE FIBER STOCK

BACKGROUND OF THE INVENTION

This invention relates to processing textile fibers and particularly to special use of apparatus for opening, cleaning and carding fibers.

Conventionally fibers, particularly cotton, have been opened from bale and cleaned on blowroom machines which act to separate the fibers, ideally to single fiber state, and to extract at least some of the trash from the fibers. Following this process the fibers have been carded to extract further trash and to straighten and align the fibers.

More particularly apparatus has been provided comprising a plurality of blowroom machines for opening and cleaning the fibers from a supply thereof, a plurality of carding machines for receiving fibers from the blowroom machines, one or more of the machines including means for separating from the fibers waste material which includes a proportion of fibers and means for collecting the waste material.

More recently attention has been concentrated on more effectively cleaning the trash from the fibers both in view of the development of openend spinning which is very sensitive to trash in the fibers and in view of impending legislation on dust levels emitted in fiber processing.

It has been known in the past to re-introduce fibers taken from the waste extraction area of a card into the fiber feed of the card. Additionally it has been known to collect centrally waste material from a number of points in a blowroom/card line for sale to or use by waste spinners specializing in spinning coarse dirty yarns from waste, for example, mop yarn.

However, it has always been a requirement of blowroom/card lines that the amount of good fibers extracted with the waste be kept to a minimum because, it will be appreciated, loss of good fiber increases the costs of spinning, despite the fact that it can be sold at much reduced price to waste spinners. Thus both the opening and cleaning blow room machines and the cards have generally been designed to extract as little fiber as possible commensurate with removing sufficient trash to effect efficient spinning. For example, cards have been designed to remove between 3 and 6% on average waste content, which has been found acceptable by spinners.

SUMMARY OF THE INVENTION

It is an object of the invention to provide an improved method for opening, cleaning and carding fibers wherein cleaning is substantially improved.

According to the present method there are provided steps for receiving the waste material and extracting fibers therefrom and for supplying the extracted fibers to one of the blowroom machines.

In order to gain the best advantage from the method individual separating means on the individual machines now can be arranged to separate much higher levels of waste from the fiber supply than would normally be acceptable. In this way higher levels of trash are thus separated from the bulk of good fibers, albeit at the expense of separating far higher levels of good fiber with the trash, which then are supplied by the fiber recovery device back to the blowroom machines.

Preferably waste extracted in the blowroom machines, such as the bale opener and stepped-cleaner machines, is returned to the fiber recovery device and similarly waste material from the cards at the taker-in or lickerin is so returned.

In a preferred embodiment, the present fiber recovery device includes a beater or taker-in for extracting the useful fibers from the bulk waste, and the thus extracted fibers are then fed to a conveyor which includes an opening for receiving soft waste, for example waste sliver and roving, from the fiber processing system.

According to the invention, there is provided a method characterized by the steps of separating a higher level of fibers than would conventionally be acceptable, collecting the waste material and extracting therefrom fibers and returning the extracted fibers to the supply.

DESCRIPTION OF THE PREFERRED EMBODIMENT

Figure 1:
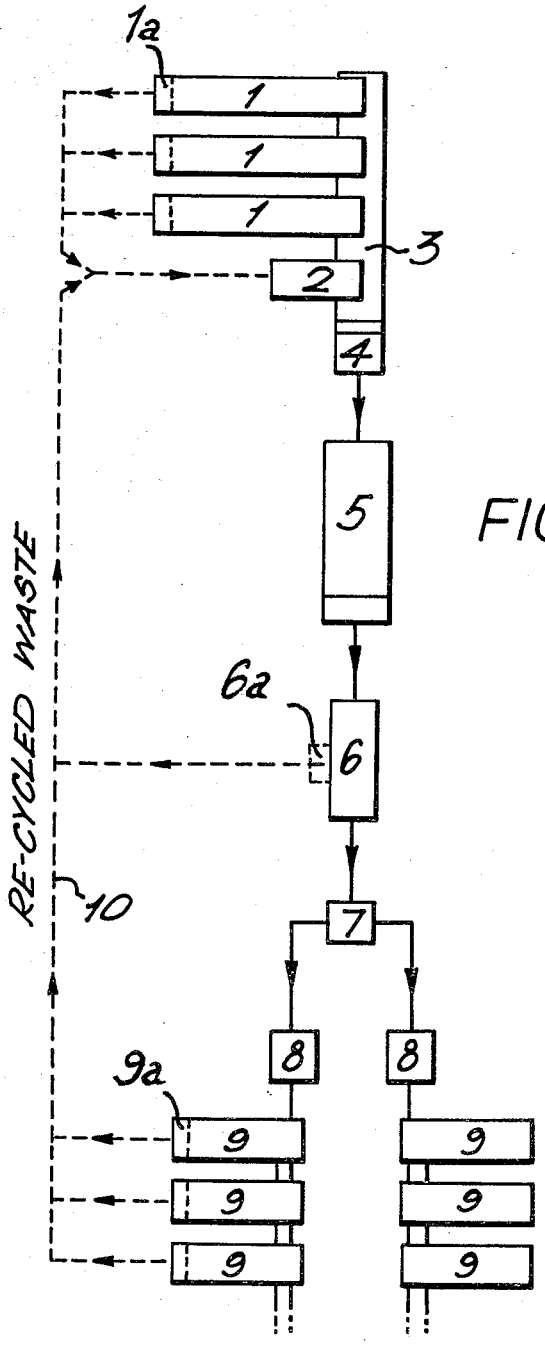
FIG. 1 is a schematic diagram of a blowroom/carding line of machines for processing particularly cotton fibers.

As schematically shown in FIG. 1, the apparatus for processing particularly cotton but also other fibers if desired, comprises three bale openers 1 of the kind described in for example Russian Pat. No. 375687. The bale openers 1 are arranged to receive a plurality of bales and simultaneously to remove fibers or tufts therefrom, and includes trash removal devices shown schematically at 1a for separating waste from fibers or tufts. Since fibers are not fully broken down at this stage to the single fiber state, some good fiber, which is to say fiber useful in the later formation of yarn, tends to be ejected into the waste with the trash and this fiber content is of a level higher than would economically be acceptable. Conventionally no trash is removed at this point in the processing line.

From the bale openers 1 fibers are fed onto a conveyor 3 which carries the fibers to a beater feed unit and jet stream or aerodynamic cleaner 4 which is of conventional arrangement for further opening of the fibers and removing further trash left in at the bale opener 1.

The fibers then are collected and blended in a stack mixer 5 of conventional arrangement, in one example of which the fibers are fed into a stack either vertically or horizontally and subsequently withdrawn at right angles to the feed direction to effect blending out of any irregularities in the mixture of fibers fed along the conveyor 3.

Following the stack mixer 5 a further cleaning process is carried out in an ultracleaner or stepped cleaner for example as shown in the copending U.S. Pat. application Ser. No. 918,304, wherein waste material containing some good fiber is removed by a device 6a from fibers to be processed. Substantially higher levels of fiber are contained in the separated waste than would normally be acceptable with cleaners of this kind.

The opened and cleaned fibers are then fed via a conventional two way distributor 7 and chute feeder units 8 with associated chutes to a plurality of cards 9. The cards may be of conventional form including waste removal points shown schematically at 9a under the taker-in, at the flats and if required at other points, for example, by suction at various positions in the fiber travel through the card.

The fibers are thus, in use, opened, cleaned and carded by the blowroom machines 1 to 8 and the carding machines 9.

Figure 2:
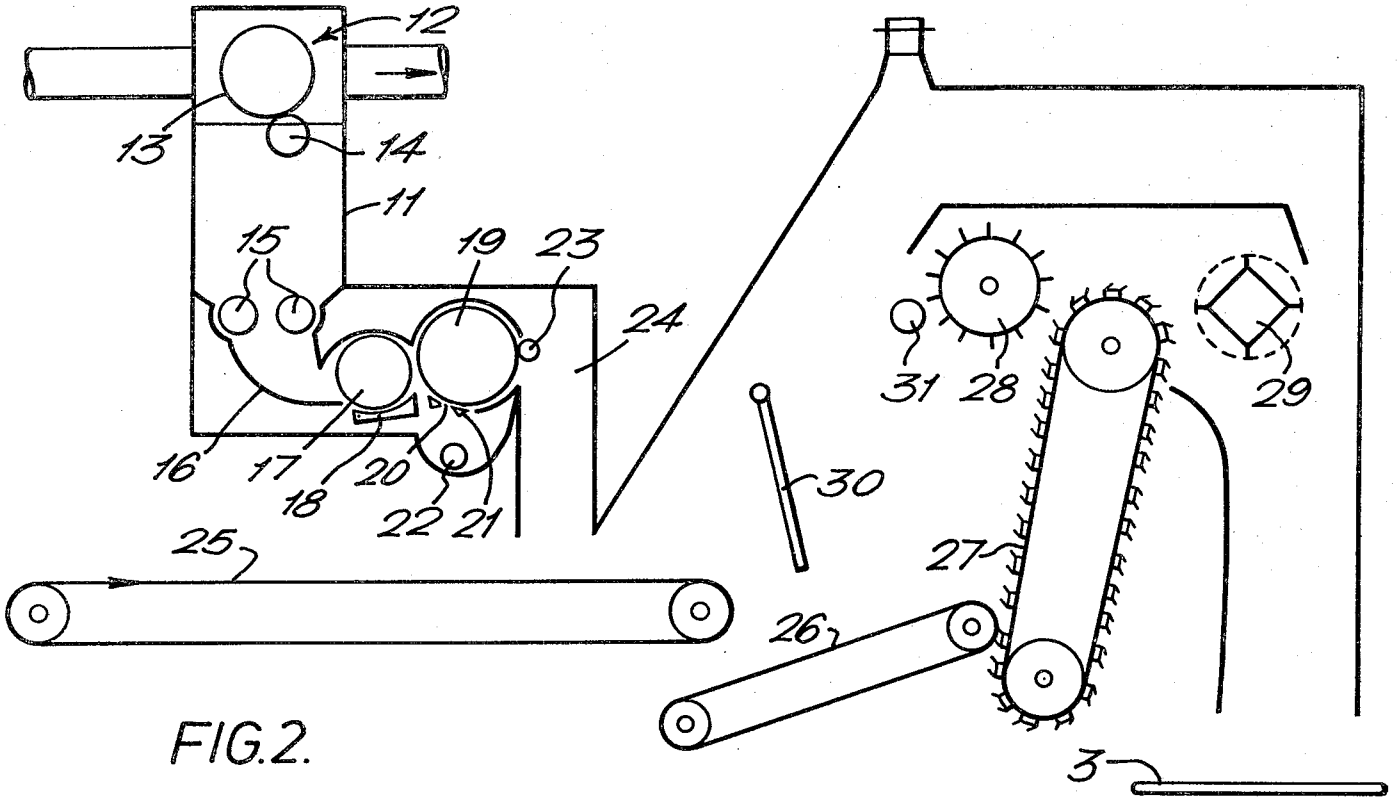
FIG. 2 is a schematic side elevation of the fiber recovery device 2 of FIG. 1.

Waste collected from the bale openers 1, the stepped cleaner 6 and the taker-in and if desirable the flat strips of the card 9 is collected by suction ducts 10 communicating with a fiber recovery device 2, as are now shown more fully in FIG. 2.

The machines are arranged and adjusted such that the waste removed will contain a substantial amount of good fiber, that is, an amount which makes it economically desirable to re-introduce the fibers into the blowroom supply. To obtain best advantage, this level is higher than would conventionally be acceptable in order to ensure the extraction of high levels of trash. This is particularly applicable to the carding machines where waste above 6% of the mass fed to them is extracted by specific setting of the carding parameters and generally is of the order of 10%.

The ducts 10 combine with a single duct passing through a chute 11 to a fan (not shown). Within the chute 11 is positioned a condensor 12 consisting of a rotating perforated drum 13 into which the air is drawn by the fan to deposit the waste material on the outside for stripping by a roller 14 and collection within the chute 11.

The stored waste material is compressed and fed forwardly by a pair of rollers 15 of the order of a meter in length to form a wide lap which passes over a guide plate 16 to a feed roller 17 and a co-operating feed plate 18. From there the waste and fiber lap is opened by a card-clothed beater or taker-in roller 19 rotating at the order of 1200 r.p.m. which opens the lap and in the manner of a card taker-in ejects the trash content from the waste material through an opening 20 defined by grid bars 21. In an alternative arrangement a stripping edge can be employed set at a suitable position to extract from the waste material as much trash as possible without withdrawing an unacceptable level of good fibers. The waste material ejected is transported through a suction duct 22 for collection.

The good fibers remaining on the beater 19 is stripped by a roll 23 for deposit via a chute 24 on a feed lattice 25. The lattic 25 forms part of a waste hopper feeder and includes an opening prior to the chute 24 for receiving soft waste for example sliver and roving from later fiber processing.

The waste hopper feeder comprises a bottom lattice 26 which receives the mixed soft waste and recovered fiber from the lattice 25 and carries it forward to an inclined spiked lattice 27.

Motion of the lattice 27, an evener roller 28, the bottom lattice 26 and a paddle bar 30 causes tumbling of the fiber within the hopper and mixing of the various components fed on the lattice 25. A stripper roller 31 clears fibers from the evener roller 28 and returns them to the mass of tumbling fibers. The fiber is thus carried upwardly by the spiked lattice toward the evener roller 28 which controls the amount of feed of fibers to a beater roller 29 and thence onto the conveyor 3. In this way the good fiber recovered from the waste is returned to the fiber supply on the conveyor 3 for re-processing in the cleaning, blending and carding machines 4 to 9.

I claim:

1. In a method for separating trash from usable fibers for subsequent use of the fibers to make yarn, which method employs a system for cooperating machines to effect its steps, at least some of which machines contain means for separating a waste material from the bulk of fibers being processed and wherein said waste material contains both trash and otherwise usable fibers, the improvement comprising the steps for separating or extracting said waste materials from said bulk of fibers at a plurality of said machines having said means therefor, wherein said separating step is performed in a manner for providing in each of said separated waste materials an abnormally high proportion of otherwise usable fibers and for providing in the bulk of fibers remaining after said separating an abnormally low proportion of trash, bringing together said plurality of separated waste materials containing said abnormally high proportion of fibers, reseparating said separated waste materials into a bulk of trash containing some otherwise usable fibers and a further bulk of fibers containing some trash, and for bringing together said further bulk of reseparated fibers with said bulk of fibers for further processing of said fibers to form yarn.

2. The improved method of claim 1, wherein said step for bringing together said further bulk and said bulk of fibers is performed at a location prior to where said bulk of fibers enters one of said machines having separating means.

3. The improved method of claim 2, wherein said one of said machines is a card.

4. The improved method as in claim 2, wherein said one of said machines is a blowroom machine.

5. The improved method of claim 2, wherein said further processing of said fibers includes a repeat of the steps there defined.

* * * * *